US012577475B2

(12) United States Patent
Mukherjee et al.

(10) Patent No.: US 12,577,475 B2
(45) Date of Patent: Mar. 17, 2026

(54) PROCESS FOR CONVERSION OF VERY LIGHT, SWEET CRUDE OIL TO CHEMICALS

(71) Applicant: LUMMUS TECHNOLOGY LLC, Houston, TX (US)

(72) Inventors: Ujjal Mukherjee, Houston, TX (US); Pedro Santos, Houston, TX (US); Kandasamy Sundaram, Houston, TX (US)

(73) Assignee: Lummus Technology LLC, Houston, TX (US)

( * ) Notice: Subject to any disclaimer, the term of this patent is extended or adjusted under 35 U.S.C. 154(b) by 223 days.

(21) Appl. No.: 18/488,395

(22) Filed: Oct. 17, 2023

(65) Prior Publication Data

US 2024/0124374 A1 Apr. 18, 2024

Related U.S. Application Data

(60) Provisional application No. 63/379,861, filed on Oct. 17, 2022.

(51) Int. Cl.

| | |
|---|---|
| ***C10G 51/06*** | (2006.01) |
| ***C10G 9/36*** | (2006.01) |
| ***C10G 69/06*** | (2006.01) |

(52) U.S. Cl.

CPC ..... *C10G 51/06* (2013.01); *C10G 9/36* (2013.01); *C10G 69/06* (2013.01); *C10G 2400/20* (2013.01)

(58) Field of Classification Search

CPC ..... C10G 9/36; C10G 51/06; C10G 69/06

See application file for complete search history.

(56) References Cited

U.S. PATENT DOCUMENTS

2019/0023999 A1* 1/2019 Sundaram ..... C10G 69/14
2020/0291311 A1* 9/2020 Al-Sayed ..... C10G 9/16
(Continued)

FOREIGN PATENT DOCUMENTS

TW 202104565 A 2/2021

OTHER PUBLICATIONS

International Search Report issued in International Application No. PCT/US2023/035321 mailed on Mar. 19, 2024 (5 pages).
(Continued)

*Primary Examiner* — Renee Robinson
(74) *Attorney, Agent, or Firm* — Osha Bergman Watanabe & Burton LLP

(57) ABSTRACT

Systems and processes for converting light or very light sweet crudes and condensates to chemicals and petrochemicals. The process includes providing a hydrocarbon feedstock comprising a crude oil or condensate having an API gravity of at least 35, a sulfur content of less than 0.2 wt %, and less than 10 wt % of hydrocarbons having a normal boiling point above 575° C. The hydrocarbon feedstock is heated and separated to recover a light fraction, a middle fraction, and optionally a heavy fraction. The light fraction is steam cracked to produce a cracked light fraction and the middle fraction is separately steam cracked to produce a cracked middle fraction. The cracked light fraction and the cracked middle fraction are then separated to recover one or more product fractions including an ethylene fraction and a propylene fraction.

4 Claims, 4 Drawing Sheets

(56) References Cited

U.S. PATENT DOCUMENTS

| | | | |
|---|---|---|---|
| 2022/0017829 | A1 | 1/2022 | Al-Shafei et al. |
| 2022/0056354 | A1 | 2/2022 | Al-Sayed et al. |

OTHER PUBLICATIONS

Written Opinion issued in International Application No. PCT/US2023/035321 mailed on Mar. 19, 2024 (11 pages).
Office Action issued in Taiwanese Application No. 112139644 mailed on Jun. 17, 2024.

* cited by examiner

PROCESS FOR CONVERSION OF VERY LIGHT, SWEET CRUDE OIL TO CHEMICALS

FIELD OF THE DISCLOSURE

Embodiments of the present disclosure generally relate to conversion of crude oil to olefins and other chemicals.

BACKGROUND

Crude oil handling typically requires conventional refinery units such as crude distillation to segregate the various boiling range fractionation for further downstream processing. Refinery and petrochemical complexes are segregated and operate independently of each other. The conventional and independent refinery configuration is capital and energy intensive.

High-boiling compounds in crude oil may cause significant operational issues if they are sent to a steam cracker. High boiling compounds have a propensity to form coke, due in large part to their high asphaltene content. Therefore, the high boiling compounds are typically removed before sending the lighter fractions to different petrochemicals units, such as a steam cracker or an aromatic complex.

The removal process, however, increases the capital cost of the overall process and lowers profitability, as the removed high-boiling compounds can only be sold as low-value fuel oil. In addition, conversion of vacuum residue without significant formation of heavy polynuclear aromatics (HPNAs) that are detrimental to steam cracker furnaces downstream of the process has been a challenge to date. HPNAs lead to rapid coke formation in the steam cracker furnace, which necessitates frequent decoke cycles, decreasing the overall on-stream factor of the complex.

Further, the vacuum residue portion of the crude oil is very deficient in hydrogen, which decreases the yield of valuable chemicals in the steam cracking furnaces.

In general, the typical refinery plus petrochemical complex and other traditional processes for converting whole crudes typically convert less than 50 percent of the crude to the more desirable end products, including petrochemicals such as ethylene, propylene, butenes, pentenes, and light aromatics, for example. Generally, 20 percent of the whole crude is removed up front in processing, removing the heaviest components that are hard to convert. About another 20 percent of the whole crude is typically converted to pyrolysis oil, and about 10 percent is over-converted to methane.

SUMMARY

In one aspect, embodiments herein relate to a process for converting light or very light sweet crudes and condensates to chemicals and petrochemicals. The process includes providing a hydrocarbon feedstock comprising a crude oil or condensate having an API gravity of at least 35, a sulfur content of less than 0.2 wt %, and less than 10 wt % of hydrocarbons having a normal boiling point above 575° C. The process also includes heating and separating the hydrocarbon feedstock to recover a light fraction, a middle fraction, and optionally a heavy fraction. The light fraction is steam cracked to produce a cracked light fraction. The middle fraction is steam cracked to produce a cracked middle fraction. The cracked light fraction and the cracked middle fraction are then separated to recover one or more product fractions including an ethylene fraction and a propylene fraction.

In some embodiments, the light fraction and the middle fraction are steam cracked without any intermediate processing. In embodiments where a heavy fraction is recovered, the process includes hydroprocessing the heavy fraction to produce a converted heavy fraction having a higher hydrogen content than the heavy fraction, and steam cracking the converted heavy fraction to produce a cracked heavy fraction. The resulting cracked heavy fraction may then be collectively separated with the cracked light fraction and the cracked middle fraction to recover the one or more product fractions.

In various embodiments, the one or more product fractions include a pyrolysis oil fraction. In such embodiments, the process may further include hydroprocessing the heavy fraction and the pyrolysis oil fraction to produce the converted heavy fraction.

In another aspect, embodiments herein relate to a process for converting light or very light sweet crudes and condensates to chemicals and petrochemicals. The process includes providing a hydrocarbon feedstock comprising a crude oil or condensate having an API gravity of at least 35 and less than 10 wt % of hydrocarbons having a normal boiling point above 575° C. The hydrocarbon feedstock is heated and separated in one or more stages to recover a light fraction, a middle fraction, and optionally a heavy fraction. The light fraction is steam cracked to produce a cracked light fraction. The middle fraction is hydroprocessed to produce a converted middle fraction having a higher hydrogen content than the middle fraction, and then the converted middle fraction is steam cracked to produce a cracked middle fraction. The cracked light fraction and the cracked middle fraction are then separated to recover one or more product fractions including an ethylene fraction and a propylene fraction.

In some embodiments, the light fraction is steam cracked without any intermediate processing. In embodiments where a heavy fraction is recovered, the process includes hydroprocessing the heavy fraction to produce a converted heavy fraction having a higher hydrogen content than the heavy fraction, and steam cracking the converted heavy fraction to produce a cracked heavy fraction. The resulting cracked heavy fraction may then be collectively separated with the cracked light fraction and the cracked middle fraction to recover the one or more product fractions.

In various embodiments, the light fraction has an end boiling point in a range from 160° C. to 250° C. and the middle fraction has an end boiling point in a range from 500° C. to 540° C.

In yet another aspect, embodiments herein relate to a system for converting light or very light sweet crudes and condensates to chemicals and petrochemicals. The system includes a feed source containing a hydrocarbon feedstock comprising a crude oil or condensate having an API gravity of at least 35, a sulfur content of less than 0.2 wt %, and less than 10 wt % of hydrocarbons having a normal boiling point above 575° C. A flow line may be provided for feeding the hydrocarbon feedstock to convective coils of a cracking furnace for heating the hydrocarbon feedstock to produce a heated hydrocarbon feedstock. A separator is provided for separating the hydrocarbon feedstock to recover a light fraction and a residual liquid fraction. Convective coils of second cracking furnace are provided for heating the residual liquid fraction to produce a heated residual fraction, and a second separator is provided for separating the heated residual fraction to recover a middle fraction and a heavy fraction. Radiant coils of the cracking furnace steam crack the light fraction to produce a cracked light fraction. Radiant coils of the second cracking furnace steam crack the middle fraction to produce a cracked middle fraction. The system further includes a separation system for collectively separating the cracked light fraction and the cracked middle fraction to recover one or more product fractions including an ethylene fraction and a propylene fraction.

In some embodiments, the system further includes a hydroprocessing unit for increasing a hydrogen content of the middle fraction downstream of the second separator and upstream of the radiant coils of the second cracking furnace.

In various embodiments, the system further includes a hydroprocessing unit for increasing a hydrogen content of the heavy fraction to produce a hydroprocessed heavy fraction. Radiant coils of a same or different cracking furnace are provided for steam cracking the hydroprocessed heavy fraction to produce a cracked heavy fraction. A flow line is also provided for feeding the cracked heavy fraction to the separation system for collectively separating the cracked light fraction, the cracked middle fraction, and the cracked heavy fraction to recover the one or more product fractions.

DETAILED DESCRIPTION

Figure 1:
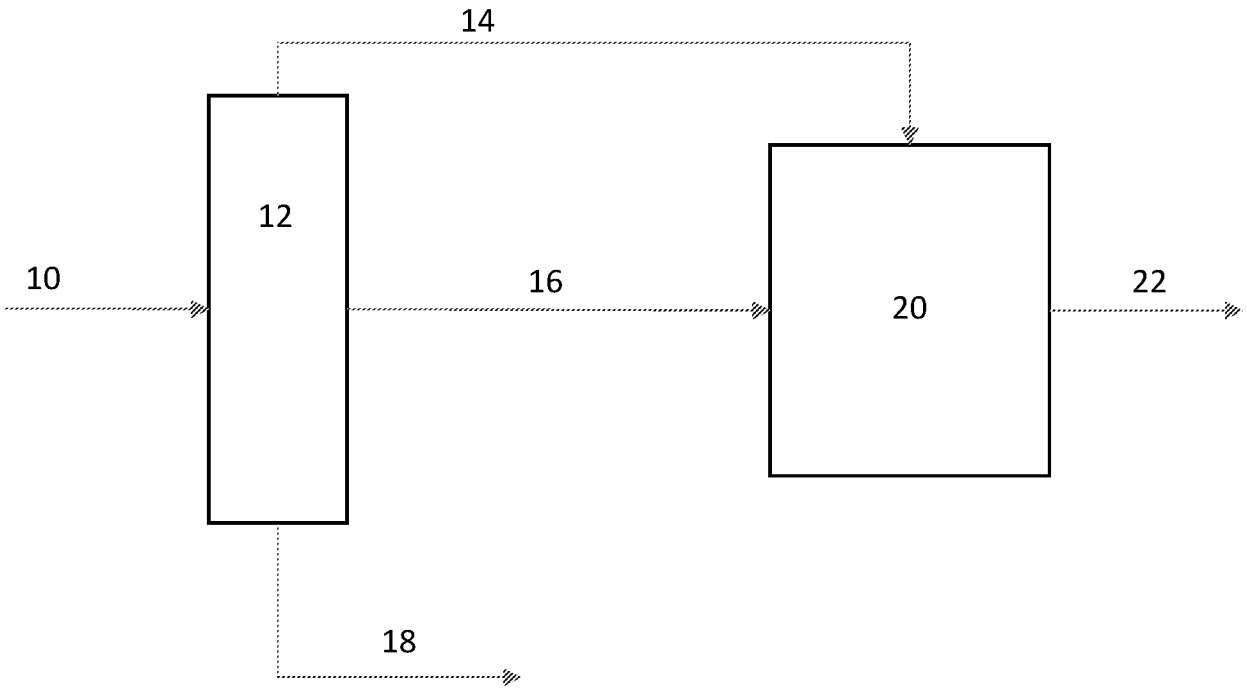
FIGS. 1-4 illustrate simplified process flow diagrams of systems and processes according to one or more embodiments disclosed herein.

As used herein, the term "petrochemicals" refers to hydrocarbons including light olefins and diolefins and C6-C8 aromatics. Petrochemicals thus refers to hydrocarbons including ethylene, propylene, butenes, butadienes, pentenes, pentadienes, as well as benzene, toluene, and xylenes. Referring to a subset of petrochemicals, the term "chemicals," as used herein, refers to ethylene, propylene, butadiene, 1-butene, isobutylene, benzene, toluene, and para-xylenes.

Hydrotreating is a catalytic process, usually carried out in the presence of free hydrogen, in which the primary purpose when used to process hydrocarbon feedstocks is the removal of various metal contaminants (e.g., arsenic), heteroatoms (e.g., sulfur, nitrogen and oxygen), and aromatics from the feedstock. Generally, in hydrotreating operations cracking of the hydrocarbon molecules (i.e., breaking the larger hydrocarbon molecules into smaller hydrocarbon molecules) is minimized. As used herein, the term "hydrotreating" refers to a refining process whereby a feed stream is reacted with hydrogen gas in the presence of a catalyst to remove impurities such as sulfur, nitrogen, oxygen, and/or metals (e.g., nickel, or vanadium) from the feed stream (e.g., the atmospheric tower bottoms) through reductive processes. Hydrotreating processes may vary substantially depending on the type of feed to a hydrotreater. For example, light feeds (e.g., naphtha) contain very little and few types of impurities, whereas heavy feeds (e.g., atmospheric tower bottoms (ATBs)) typically possess many different heavy compounds present in a crude oil. Apart from having heavy compounds, impurities in heavy feeds are more complex and difficult to treat than those present in light feeds. Therefore, hydrotreating of light feeds is generally performed at lower reaction severity, whereas heavy feeds require higher reaction pressures and temperatures.

Hydrocracking refers to a process in which hydrogenation and dehydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

"Conditioning" and like terms as used herein refers to conversion of hydrocarbons by one or both of hydrocracking and hydrotreating. "Destructive hydrogenation" and like terms refers to cracking of the hydrocarbon molecular bonds of a hydrocarbon, and the associated hydrogen saturation of the remaining hydrocarbon fragments, which can create stable lower boiling point hydrocarbon oil products, and may be inclusive of both hydrocracking and hydrotreating.

"API gravity" refers to the gravity of a petroleum feedstock or product relative to water, as determined by ASTM D4052-11.

Embodiments herein relate to processes and systems that take crude oil, such as a light or very light sweet crude oil, and/or low value heavy hydrocarbons as feed and produces petrochemicals, such as light olefins (ethylene, propylene, and/or butenes) and aromatics. More specifically, embodiments herein are directed toward methods and systems for making olefins and aromatics by thermal cracking of a pre-conditioned light sweet crude oil. A light sweet crude may be separated into a light cut, a middle cut, and a heavy cut, each defined below. Processes of embodiments herein may then directly steam crack the light cut, or the light cut and middle cut. In some embodiments, the middle cut may be conditioned to improve the feedstock quality before feeding the conditioned middle cut to the steam cracker. The heavy cut, being a minor fraction of a light sweet crude, may be discarded or may be further processed to produce feedstocks useful as a steam cracker feedstock.

Hydrocarbon mixtures useful in embodiments disclosed herein may include various hydrocarbon mixtures having a boiling range, where the end boiling point of the mixture may be greater than 500° C., such as greater than 525° C., 550° C., or 575° C. The amount of high boiling hydrocarbons, such as hydrocarbons boiling over 550° C., may be as little as 0.1 wt %, 1 wt % or 2 wt %, but can be as high as 10 wt %, 25 wt %, 50 wt % or greater. The description is explained with respect to crude oil, such as whole crude oil, but any high boiling end point hydrocarbon mixture can be used. However, processes disclosed herein can be applied to crudes, condensates and hydrocarbons with a wide boiling curve and end points higher than 500° C. Such hydrocarbon mixtures may include whole crudes, virgin crudes, hydroprocessed crudes, gas oils, vacuum gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, natural gas condensates, atmospheric pipestill bottoms, vacuum pipestill streams including bottoms, wide boiling range naphtha to gas oil condensates, heavy non-virgin hydrocarbon streams from refineries, vacuum gas oils, heavy gas oils, atmospheric residuum, hydrocracker wax, and Fischer-Tropsch wax, among others. In some embodiments, the hydrocarbon mixture may include hydrocarbons boiling from the naphtha range or lighter to the vacuum gas oil range or heavier.

When the end boiling point of the hydrocarbon mixture may be high, such as over 550° C. in some embodiments, the hydrocarbon mixture cannot be processed directly in a steam pyrolysis furnace to produce olefins. The presence of these heavy hydrocarbons results in the formation of coke in the furnace, where the coking may occur in one or more of the convection zone preheating coils or superheating coils, in the radiant coils, or in transfer line exchangers, and such coking may occur rapidly, such as in few hours. Whole crude is not typically cracked commercially, as it is not economical. Whole crude is generally fractionated, and only specific cuts are used in a steam pyrolysis heater to produce olefins. The remainder is used in other processes. The cracking reaction proceeds via a free radical mechanism. Hence, high ethylene yield can be achieved when it is cracked at high temperatures. Lighter feeds, like butanes and pentanes, require a high furnace temperature to obtain high olefin yields. Heavy feeds, like gas oil and vacuum gas oil (VGO), require lower temperatures. Crude contains a distribution of compounds from butanes to VGO and residue (material boiling over 550° C.). Subjecting the whole crude without separation at high temperatures produces a high yield of coke (byproduct of cracking hydrocarbons at high severity) and plugs the furnace. The steam pyrolysis furnace has to be periodically shut down and the coke is cleaned by steam/air decoking. The time between two cleaning periods when the olefins are produced is called run length. When whole crude is cracked without separation, coke can deposit in the convection section coils (vaporizing the fluid), in the radiant section (where the olefin producing reactions occur) and/or in the transfer line exchanger (where the reactions are stopped quickly by cooling to preserve the olefin yields).

While processes herein may be useful for various hydrocarbon mixtures having a wide boiling range, embodiments herein are particularly advantageous for light or very light sweet crude oils. As used herein, light crude oils have an API Gravity of at least 35, at least 40 in some embodiments, and very light crude oils have an API Gravity of at least 42, at least 45 in some embodiments. Such feeds may additionally have a boiling curve where at least 90 wt. % of the material boils below 575° C. Further, the light or very light sweet crude oils may have a sulfur content of less than 0.2 wt %, as well as low metal content and low Conradson Carbon content. Examples of suitable light sweet crudes useful in embodiments herein may include, for example, Permian Crude oils or West Texas Light Crude oils, Arabian or Agbami Light Crude Oil, and other crude oils that have less than 10 wt % of the material boiling above 575° C. Processes herein may also be useful for processing of condensates, having very low high boiling materials (>575° C.).

Embodiments herein are thus directed toward processes that take very light, sweet crude oil or condensates as a feedstock and produce chemical and petrochemical products. The processes and systems herein may include a separation section, such as a HOPS (Heavy Oil Processing Scheme), integrated with a mixed feed steam cracker with optional hydroprocessing or hydrotreating for select intermediate streams.

The light crude oil or condensate feed is separated and processed such that a high-quality steam cracker feed is being sent to the mixed feed steam cracker to maximize the percentage of valuable chemicals produced from a barrel of crude oil while maintaining a reasonable decoking frequency of the steam cracking heaters. Due to the reduced amount of asphaltenes and micro-carbon residue in light crude oils or condensates, formation of HPNAs are managed via a small bleed, rather than catalytic or thermal conversion.

Processes and systems according to embodiments herein may include a feed preparation section, which may include a desalter, for example. The desalted crude may then be separated into a light cut, a middle cut, and a heavy cut. The crude oil and/or condensate is initially separated in the upfront separation section, such as a HOPS tower, into distinct fractions. The distinct fractions, as noted, may include: a light cut, having an end boiling point in the range from about 200-250° C., which is rich in normal paraffins and thus a good steam cracker feedstock; a middle cut, having a boiling range from an initial boiling point of about 200-250° C. to an end boiling point of 500-540° C., the middle cut containing distillate and gasoil range material; and a heavy cut (residue stream), containing the hydrocarbons boiling above 500-540° C.+. The initial boiling point of the middle and heavy cuts is similar to the end boiling point of the light and middle cuts, respectively.

While embodiments are described as including a light cut point below about 250° C., such as a 160° C.– fraction and a heavy cut boiling above about 500° C.-540° C., such as a 520° C.+ fraction, it is noted that the actual cut points may be varied based on the type of whole crude or other condensate fractions being processed. For example, for a crude containing a low metals or nitrogen content, or a large quantity of "easier-to-process" components boiling, for instance, at temperatures up to 525° C., 540° C., or 565° C., it may be possible to increase the middle/high cut point while still achieving the benefits of embodiments herein. Similarly, the low/mid cut point may be as high as 220° C. in some embodiments, or as high as 250° C. in other embodiments. The ability to vary the cut points may add flexibility to process schemes according to embodiments herein, allowing for processing of a wide variety of feeds while still producing the product mixture desired.

The 500-540° C.+ residue portion of the crude oil is very deficient in hydrogen, which decreases the yield of valuable chemicals in the steam cracking furnaces. Removing this portion allows for the stable operation of the steam cracking furnaces and maintaining the high conversion to high quality petrochemicals. By optionally hydroprocessing or hydrotreating the residue portion to increase the hydrogen content, the total chemicals yield can be increased per barrel of feed. The optional inclusion of hydroprocessing or hydrotreating on the 500-540° C.+ streams provides the opportunity to recycle pyrolysis oil from the downstream mixed feed steam cracker to increase overall conversion of feed to chemicals while still limiting the heaviest molecules from the crude oil from reaching the steam cracker to maintain high on-stream factors.

The light cut is then sent to a steam cracker. Due to the composition of the light cut, being rich in normal paraffins, the light cut may be sent to the steam cracker without any intermediate processing.

The middle cut is also sent to the steam cracker. In some embodiments, the middle cut may be sent to the steam cracker without any intermediate processing. In other embodiments, the middle cut is processed in a first hydroprocessing or hydrotreating section, which may utilize fixed bed hydroprocessing or hydrotreating reactors operating at mild severity to increase hydrogen content, and the effluent from the first hydroprocessing or hydrotreating section is sent to the steam cracker.

While referring generically to "steam cracker" above, processes and systems herein may include one or more furnaces, each having one or more convective and radiant coils for preheating, superheating, and thermally cracking the respective feeds. Further, steam crackers, or "steam cracker sections" or "steam cracker zones" herein may include quench systems to rapidly cool the effluent from the radiant coils and separation systems, which may include one or more distillation columns, for separating the steam cracker effluents into various hydrocarbon fractions, such as C2, C3, C4, naphtha, diesel, gas oil, vacuum gas oil, pyrolysis oil, and residue fractions, among others and combinations of two or more of these, such as a C2-C4 cut, for example.

In some embodiments, the light cut and middle cut may be fed to separate heaters within the steam cracker section of the plant. In other embodiments, the light cut and middle cut may be fed to separate coils of the same heater. Other various permutations using separate or same heaters for various feed fractions are also contemplated.

In some embodiments, the residue portion (heavy cut) is withdrawn from the system and not further processed. In other embodiments, the residue fraction is sent to a hydroprocessing or hydrotreating step in which the hydrogen content of the heavy fraction is increased, and it is then sent to the steam cracking heaters to produce chemicals, thus increasing the overall production of total chemicals. Optionally, where the value of very-low sulfur fuel oil is high, the hydroprocessing or hydrotreating step can be totally avoided leading to even more CAPEX, OPEX, and CO2 emissions reduction.

As noted above, the individual sections of the plant, including separations, steam cracking, and the optional hydroprocessing or hydrotreating blocks, are deeply integrated, meaning that they are combined into one unit/technology. The operation and design of each block is tailored such that the product of each is suitable for either the following block or the end goal of chemicals production. In a traditional setup, this integration is not possible due to the differing requirements of intermediate and respective final products.

Differences between this and various other conventional technologies for converting crude to chemicals, such as an integrated refinery, are the optimization and integration, and the capital savings which are achieved as a result. Without the objective of producing fuels products, such as gasoline or diesel, large portions of the traditional refinery equipment required to make such fuels products are no longer necessary, thus reducing the overall capital investment. Configurations disclosed herein also minimize and/or eliminate the need to refinery auxiliary units such as hydrogen manufacturing, amine regeneration, sulfur recovery, sour water stripping, etc.

The upfront separation system, such as a two-stage HOPS system is deeply integrated with the mixed feed steam cracking heaters which both reduces capital investment and increases the overall efficiency of the unit by optimizing the recovery of heat into the upfront separation process. The configurations herein combine the energy requirements for the upfront crude separation to meet the requirements of the downstream cracking heater vaporization requirement.

The system is designed to process very light, sweet crude oil feedstocks (with an API~>45° with small residue (~500-540° C.+) content. Thus, no specialized conversion unit is required to upgrade the residue portion of the crude. The removal of this small residue cut allows for high on-stream availability in the design of the mixed feed cracking heaters. Unlike a traditional refinery for producing chemicals, feeds to the steam cracker are not limited to light components and naphtha, rather full range from naphtha to gasoil boiling range molecules are fed to the heaters and the design of the heaters and downstream system accommodate the non-traditional feeds.

Embodiments of the above-described processes are illustrated in each of FIGS. 1-4.

FIG. 1 illustrates a configuration for processing very light, sweet crude feedstocks (API)~>45° according to embodiments herein. In this embodiment, the crude feedstock 10 is fed to a two-stage HOPS (Heavy Oil Processing Scheme) 12 to produce a light fraction 14, with components boiling below about 200-250° C., a middle fraction 16, with components boiling between about 200-250° C. to 500-540° C., and an optional residue bleed fraction 18 with components boiling above about 500-540° C. The light stream 14 is sent to the Steam Cracker Section 20, including cracking furnaces, quench systems, and separations systems, without intermediate processing, as it is rich in normal paraffins and thus an excellent steam cracker feedstock. The middle fraction is also sent to steam cracker section 20 and may be fed to separate heaters within the Steam Cracker section. Following conversion within the cracking furnaces, the resulting cracked product may be quenched and separated to recover one or more chemicals streams 22.

Figure 2:
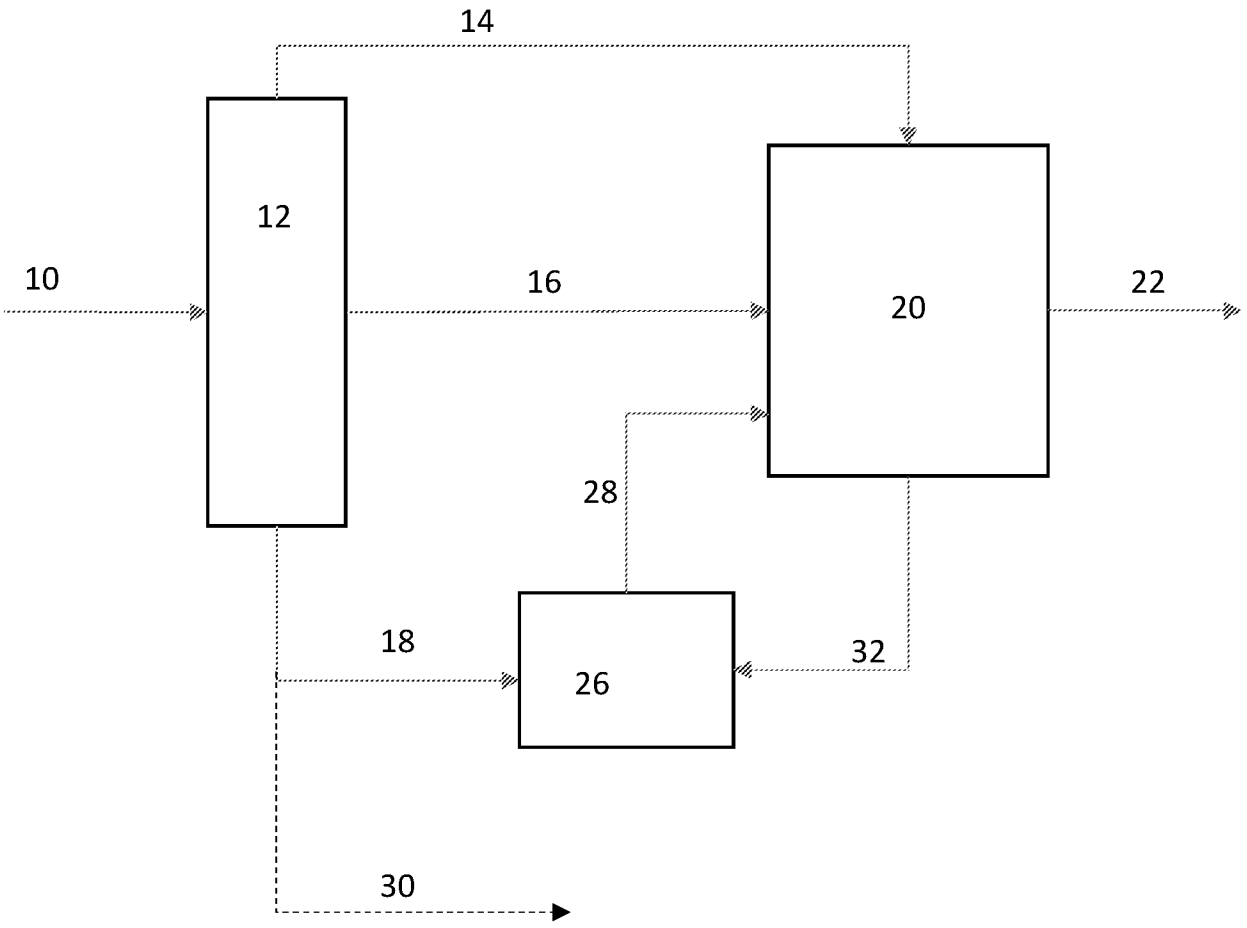

FIG. 2 illustrates a configuration processing very light, sweet crude feedstocks (API~>45° according to some embodiments herein, where like numerals represent like parts. In this embodiment, the crude feedstock 10 is fed to a two-stage HOPS (Heavy Oil Processing Scheme) 12 to produce a light fraction 14, with components boiling below about 200-250° C., a middle fraction 16, with components boiling between about 200-250° C. to 500-540° C., and a residue fraction 18 with components boiling above about 500-540° C. The light stream 14 is sent to the Steam Cracker Section 20 without intermediate processing as it is rich in normal paraffins and thus an excellent steam cracker feedstock. The middle fraction 16 is also sent to the steam cracker section 20 and may be sent to separate heaters (not illustrated) within the Steam Cracker section. The residue fraction 18 is sent to a hydroprocessing or hydrotreating section 26 in which the hydrogen content of the heavy fraction 18 is increased and the resulting hydroprocessed product 28 is then sent to the steam cracking heaters within the steam cracker section 20 to produce chemicals 22, thus increasing the overall production of total chemicals. Optionally, where the value of very-low sulfur fuel oil is high, the hydroprocessing or hydrotreating step can be totally avoided, and the heavy fraction 18 may be recovered as a blend or product stream 30 for producing a very-low sulfur fuel oil, leading to even more CAPEX, OPEX, and CO2 emissions reduction. Pyrolysis oil 32, recovered while separation of the cracked hydrocarbon products within the Steam Cracker Section is fed to the hydroprocessing or hydrotreating step along with the residue portion 18 of the crude oil feed, thus increasing overall conversion of the feedstock to chemicals.

Figure 3:
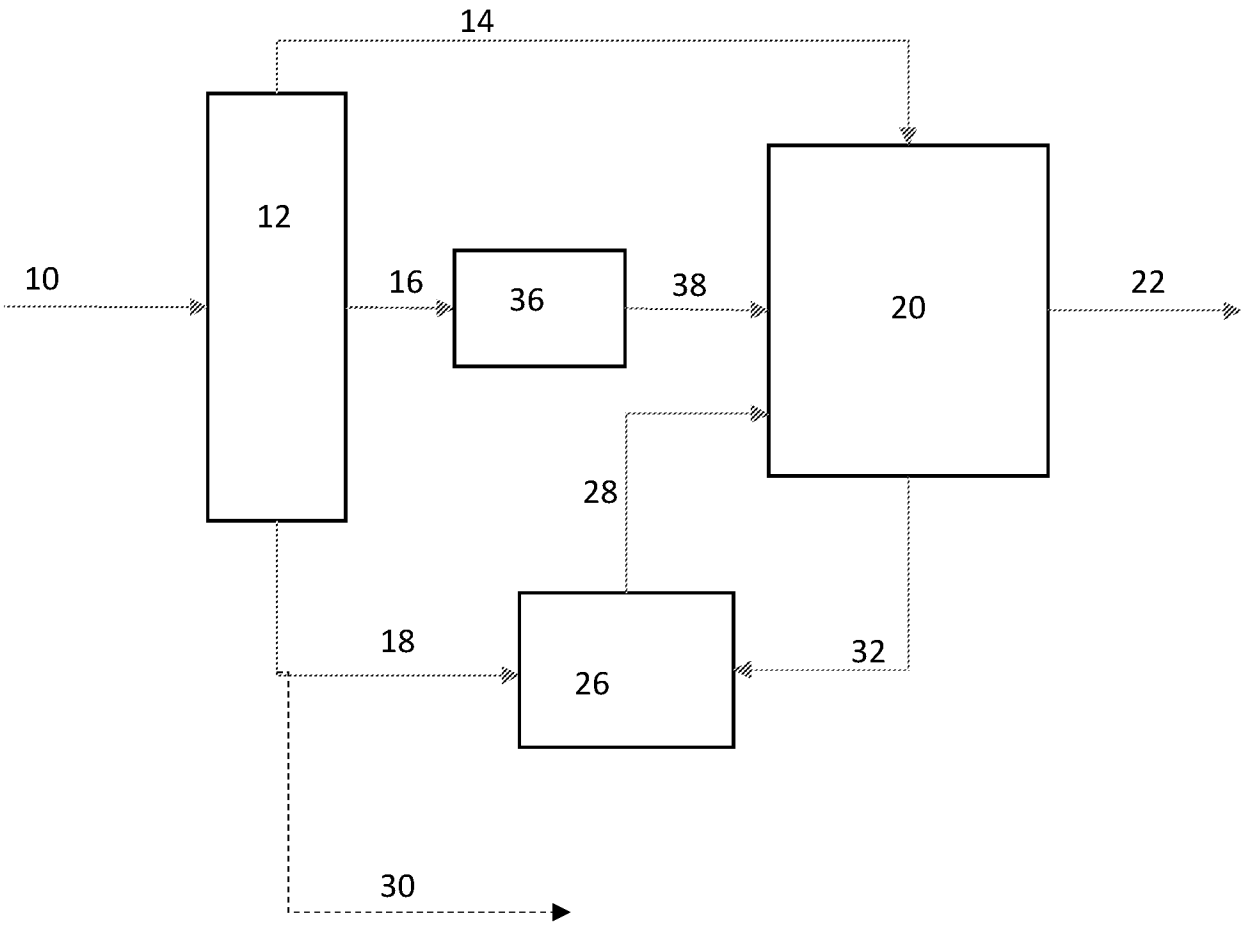

FIG. 3 illustrates a configuration processing very light, sweet crude feedstocks (API>45° according to some embodiments herein, where like numerals represent like parts. In this embodiment, the crude feedstock 10 is fed to a two-stage HOPS (Heavy Oil Processing Scheme) 12 to produce a light fraction 14, with components boiling below about 200-250° C., a middle fraction 16, with components boiling between about 200-250° C. to 500-540° C., and a residue fraction 18 with components boiling above about 500-540° C. The light stream 14 is sent to the Steam Cracker Section 20 without intermediate processing. The middle fraction 16 is processed in a first hydroprocessing or hydrotreating section 36, which may utilize fixed bed hydroprocessing or hydrotreating reactors operating at mild severity to increase hydrogen content; and the effluent 38 from the first hydroprocessing or hydrotreating section 36 is sent to the Steam Cracking Section 20. The residue fraction 18 is sent to a hydroprocessing or hydrotreating section 26 in which the hydrogen content of the heavy fraction 18 is increased and the resulting hydroprocessed product fraction 28 is then sent to the steam cracking heaters within the steam cracker section n20 to produce chemicals 22, thus increasing the overall production of total chemicals. Optionally, where the value of very-low sulfur fuel oil is high, the hydroprocessing or hydrotreating step can be totally avoided, and the heavy fraction 18 may be recovered as a blend or product stream 30 for producing a very-low sulfur fuel oil, leading to even more CAPEX, OPEX, and CO2 emissions reduction. Pyrolysis oil 32, recovered while separation of the cracked hydrocarbon products within the Steam Cracker Section is fed to the hydroprocessing or hydrotreating step along with the residue portion 18 of the crude oil feed, thus increasing overall conversion of the feedstock to chemicals.

While not illustrated in FIG. 3, hydroprocessing zones 26, 36 may include one or more hydroprocessing or hydrotreating reactors and a separation system. The reactors contain appropriate catalysts for increasing a hydrogen content of the hydrocarbons in the respective middle or heavy fractions. Reactions in the hydroprocessing or hydrotreating reactors may thus include various reactions noted above, including hydrodesulfurization, hydrocracking, hydrodenitrogenation, and other reactions used to remove metal, heteroatom, and other contaminants while increasing the hydrogen content of the hydrogen molecules therein. Following reaction, the hydroprocessed reaction products (a hydroprocess middle fraction or a hydroprocessed heavy fraction) may be fed to a separation system for recovery of any unreacted hydrogen, acid gases, the converted hydrocarbons, and optionally a residual liquid containing unconverted hydrocarbons unsuitable for steam cracking.

Figure 4:
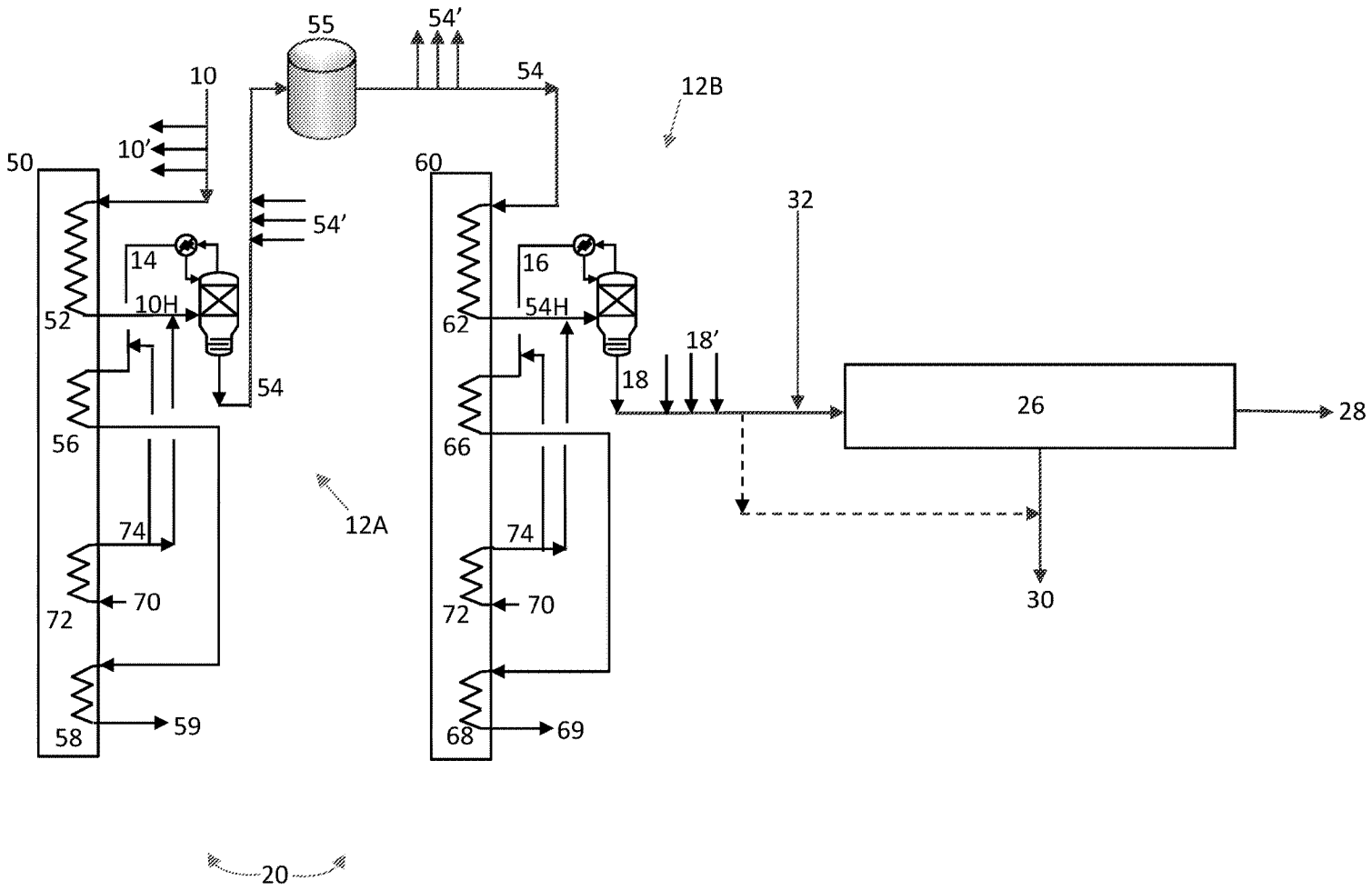

FIG. 4 illustrates an embodiment initially processing a very light sweet crude oil, such as a Permian Crude, in a manner similar to that described for FIG. 2. In this embodiment, the crude 10 is separated with a two-stage HOPS (Heavy Oil Processing Scheme) 12 to produce a light fraction (naphtha cut) 14, a middle fraction (AGO/VGO cut) 16, and a residue fraction 18 The very light sweet crude oil 10 is fed to one or more heaters, such as a convective coil 52 disposed in a convective section 50 of a cracking furnace. The heated crude 10H is then fed to a first stage separator 12A of the two-stage HOPS 12 and separated into light fraction 14 and residual liquid 54. Residual liquid 54 is then fed to one or more heaters, such as a convective coil 62 disposed in a convective section 60 of a cracking furnace, and heated. The heated residual liquid 54H is then fed to a second stage separator 12B of the two-stage HOPS 12, and separated into middle fraction 16 and residue fraction 18. Depending upon the volume of crude oil being processed, one or multiple heaters and HOPS may be used to produce and process the respective fractions, where the feeds being fed to and received from the multiple heaters are represented by 10', 54', and 18'. As also illustrated in FIG. 4, a feed surge drum 55 may be used to accumulate and distribute the multiple residual liquid streams 54, 54' as may be received from the multiple first stage HOPS 12A and to distribute residual liquid 54, 54' to the multiple heaters 60 and multiple second stage HOPS 12B.

The light fraction 14 is sent to the Steam Cracker Section 20 without intermediate processing as it is rich in normal paraffins and thus an excellent steam cracker feedstock. For thermal cracking, the light fraction 14 may be heated and superheated in one or more convective coils 56 of the same or different heater and then be fed to a radiant coil 58 for rapid heating to cracking temperatures, producing a cracked light fraction 59.

The middle fraction 16 in this embodiment is sent to separate heaters within the Steam Cracker section 20. For thermal cracking, the middle fraction 16 may be heated and superheated in one or more convective coils 66 of the same or different heater and then be fed to a radiant coil 68 for rapid heating to cracking temperatures, producing a cracked middle fraction 69.

The residue fraction 18 is sent to a hydroprocessing or hydrotreating step 26 in which the hydrogen content of the heavy fraction is increased, and then the resulting hydroprocessed product fraction 28, having improved crackability, is then sent to the steam cracking heaters (not illustrated) to produce chemicals, thus increasing the overall production of total chemicals. Following hydroprocessing, for example, the hydroprocessed reaction effluent may be separated to recover unreacted hydrogen and hydrogen sulfide, hydroprocessed hydrocarbons fed to the cracker section 20, and a residual fuel oil 30' containing unconverted heavy hydrocarbons unsuitable for thermal cracking.

The resulting cracked products, including the cracked hydroprocessed fraction derived from stream 28, the cracked light fraction 59, and the cracked middle fraction 69, are fed to the separation zone of the steam cracker section 20 to recover the light olefins, among other products, including a pyrolysis oil 32.

Optionally, where the value of very-low sulfur fuel oil is high, the hydroprocessing or hydrotreating step can be totally avoided leading to even more CAPEX, OPEX, and CO2 emissions reduction. Pyrolysis oil 32 from the Steam Cracker Section is fed to the hydroprocessing or hydrotreating step along with the residue portion 18 of the crude oil feed.

FIG. 4 further illustrates the addition of dilution steam to the light and middle cut vapor fractions. In each heater (50, 60), water or steam 70 may be superheated in one or more convective coils 72 to produce a superheated steam 74, which is mixed with the heated feedstocks (10H, 54H) and/or the vapor streams (light fraction 14 and middle fraction 16) to provide steam diluted feeds to the cracking coils. Following admixture, the steam and hydrocarbons may be superheated and sent to a radiant coil 58, 68 of the heater for cracking. The vapor fraction, such as a naphtha cut, gas oil cut, or light hydrocarbon fraction, and dilution steam mixture is further superheated in the convection section (coil 56, 66) and enters the radiant coil (58, 68). The radiant coil can be in a different cell, or a group of radiant coils in a single cell can be used to crack the hydrocarbons in the vapor fraction(s). The amount of dilution steam can be controlled to minimize the total energy. Typically, the steam is controlled at a steam to oil ratio of about 0.5 w/w, where any value from 0.05 w/w to 1.0 w/w is acceptable, such as from about 0.3 w/w to about 0.7 w/w, or from about 0.1 w/w to 0.4 w/w.

The radiant coil technology can be any type with bulk residence times ranging from 90 milliseconds to 1000 milliseconds with multiple rows and multiple parallel passes and/or split coil arrangements. They can be vertical or horizontal. The coil material can be high strength alloys with bare and finned or internally heat transfer improved tubes. The heater can consist of one radiant box with multiple coils and/or two radiant boxes with multiple coils in each box. The radiant coil geometry and dimensions and the number of coils in each box can be the same or different. If cost is not a factor, multiple stream heaters/exchangers can be employed.

Following cracking in the radiant coils, one or more transfer line exchangers may be used to cool the products very quickly and generate (super) high pressure steam. One or more coils may be combined and connected to each exchanger. The exchanger(s) can be double pipe or multiple shell and tube exchanger(s).

Instead of indirect cooling, direct quenching can also be used. For such cases, oil may be injected at the outlet of the radiant coil. Following the oil quench, a water quench can also be used. Instead of oil quench, an all water quench is also acceptable. After quenching, the products are sent to a recovery section.

As described above, embodiments herein may be useful for converting a light, sweet crude oil feed into chemicals with reduction and/or elimination of conventional refinery unit operations. A two-stage HOPS is used to segregate the crude oil into distinct fractions: a light fraction, a middle fraction, and an optional residue fraction which can be removed from the system. The light stream is sent directly to the Steam Cracker Section for conversion to chemicals. The middle fraction can be sent directly to the Steam Cracker Section or can optionally undergo mild hydroprocessing or hydrotreating in fixed bed reactors to increase hydrogen and paraffin content before being directed to the Steam Cracking Section. The residue fraction can be a bleed from the system, or sent to a hydroprocessing or hydrotreating step in which the hydrogen content of the heavy fraction is increased and it is then sent to the steam cracking heaters to produce chemicals, thus increasing the overall production of total chemicals, or optionally routed as a very-low sulfur fuel oil product when valuable.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent is:

1. A process for converting light or very light sweet crudes and condensates to chemicals and petrochemicals, the process comprising:

providing a hydrocarbon feedstock comprising a crude oil or condensate having an API gravity of at least 35, a sulfur content of less than 0.2 wt %, and less than 10 wt % of hydrocarbons having a normal boiling point above 575° C.;

heating the hydrocarbon feedstock in convective coils of a first cracking furnace and separating in a first separator to recover a light fraction and a residual liquid;

heating the residual liquid in convective coils of a second cracking furnace and separating in a second separator to recover a middle fraction and optionally a heavy fraction;

steam cracking the light fraction to produce a cracked light fraction;

steam cracking the middle fraction to produce a cracked middle fraction; and separating the cracked light fraction and the cracked middle fraction to recover one or more product fractions including an ethylene fraction and a propylene fraction, wherein the light fraction and the middle fraction are steam cracked without any intermediate processing.

2. The process of claim 1, wherein a heavy fraction is recovered, the process comprising:

hydroprocessing the heavy fraction to produce a converted heavy fraction having a higher hydrogen content than the heavy fraction; and steam cracking the converted heavy fraction to produce a cracked heavy fraction; and collectively separating the cracked heavy fraction with the cracked light fraction and the cracked middle fraction to recover the one or more product fractions.

3. The process of claim 2, wherein the one or more product fractions include a pyrolysis oil fraction, the process comprising hydroprocessing the heavy fraction and the pyrolysis oil fraction to produce the converted heavy fraction.

4. The process of claim 1, wherein the hydrocarbon feedstock has an API gravity of at least 45.

* * * * *